United States Patent [19]

Birdwell

[11] Patent Number: 4,869,100

[45] Date of Patent: Sep. 26, 1989

[54] VARIABLE ORIFICE CONTROL MEANS

[76] Inventor: J. C. Birdwell, 8535 Glencrest, Houston, Tex. 77061

[21] Appl. No.: 222,890

[22] Filed: Jul. 22, 1988

[51] Int. Cl.[4] ..... E21B 47/12

[52] U.S. Cl. ..... 73/151; 367/85

[58] Field of Search ..... 73/151, 155; 175/40, 175/45; 367/81, 83, 85

[56] References Cited

U.S. PATENT DOCUMENTS

| | | | |
|---|---|---|---|
| 3,737,843 | 6/1973 | LePeuvedic et al. | 367/85 |
| 4,266,606 | 5/1981 | Stone | 73/151 |
| 4,742,498 | 5/1988 | Barron | 367/85 |

*Primary Examiner*—Stewart J. Levy
*Assistant Examiner*—Kevin D. O'Shea
*Attorney, Agent, or Firm*—Gunn, Lee & Miller

[57] ABSTRACT

For use in a measuring while drilling (MWD) apparatus, a variable drilling fluid flow orifice including circular valve seat and valve element in the fashion of a plug is disclosed. The plug is positioned on a stem which connects with a piston in a chamber, the chamber divided into two portions. Pressure is applied on both sides of the piston to provide a pressure balance. Moreover, the flow to the chamber is determined by a pump connected with a first valve means. The first valve means has two outlet lines which connect through first and second feed lines to the piston and chamber. The pump is isolated within a housing surrounded by an annular fluid flow path for drilling fluid. In the housing, a sealed chamber is included for hydraulic fluid for operation of the pump, and the first valve means is controlled by an electrical solenoid connected with a valve stem for moving valve elements of the first valve means to control fluid flow and thereby move the plug in the circular valve seat.

11 Claims, 2 Drawing Sheets

VARIABLE ORIFICE CONTROL MEANS

SUMMARY OF THE INVENTION

The present invention is directed to a means to vary the flow area of a fluid flow orifice so that the change in flow area of the orifice is responsive to an induced electrical signal, and more particularly to a means to vary the flow area of a fluid flow orifice positioned in a down hole instrument installed in an oil well drill string whereby signals are transmitted up the drill string to a surface location. Changes in flow rate of pressurized drilling fluid are representative of the change in area of the flow orifice.

In drilling oil wells, it is desirable to log the different earth formations, well temperature, bore hole deviation, etc. as the wells are drilled. Thus various recording instruments are placed in the drill string, generally near the drill bit, to measure different information. It is also desirable to transmit this information to the surface while the well is being drilled. The most successful means of transmitting signals to the surface during the drilling process heretofore included magnification of the logged data by electronic means and employing the amplified logged data to create modulated pressure pulse signals in the circulating drilling fluid medium, the pressure pulses normally being created by valve means either momentarily restricting the flow of drilling fluid or momentarily dumping a part of the flow of drilling fluid. The pressure pulses thus created in turn travel through the drilling fluid to the surface where they are received and recorded by suitable instruments.

Applicant has developed a device which discloses an improved means to transmit the logged information to the surface which employs the technique of holding the drilling fluid pressure at a relatively constant level whereby variance of an orifice flow area down hole causes the volumetric flow rate of the drilling fluid to change responsive to data received down hole so that variations in flow rate of the drilling fluid are employed as the means to transmit the logged data to the surface along the drill string.

In conjunction with the improved means to transmit data as disclosed by a device which applicant has developed, it is desirable to have a reliable means located at the down hole signal sending location whereby a plunger or other orifice size modulating device may be utilized to vary or change the flow area of a variable orifice with the orifice size change responsive to data that is being transmitted. The present invention discloses such a means.

Because it is difficult to supply electrical power to a down hole instrument that is part of a drill string, thus it is desirable that such an instrument consume minimal power usually supplied by a battery, or the instrument may meet its energy requirement from available down hole energy. Thus the present invention is directed to a plunger means to vary, and sustain such variation, the size of the flow area of an orifice responsive to an electrical signal.

The present invention is also directed to means to change the size of the flow area of an orifice wherein the change in flow area is directly proportional to a change in magnitude of an electrical signal.

The present invention is also directed to means to change the size the flow area of an orifice wherein the change in flow area is directly proportional to a change in magnitude of an electrical signal and whereby the change in flow area of the orifice causes a change in flow of fluid passing through the orifice that is directly proportional to the change in magnitude of the electric signal.

A further object of the present invention is to disclose means to accomplish the orifice variation in size with the utilization of a minimum amount of energy; a further benefit of the present invention is to utilize energy from pressurized drilling fluid to assist in operation of the plunger means.

A further object of the invention is to disclose means to change the size in flow area of an orifice wherein the change in orifice size is responsive to the magnitude of an electric current and wherein flow rate of fluid passing through the orifice when plotted against other variables such as time, or travel, will form a curve that correlates to the magnitude of the electric current which triggered changes in flow area.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF AN EMBODIMENT

Figure 1:
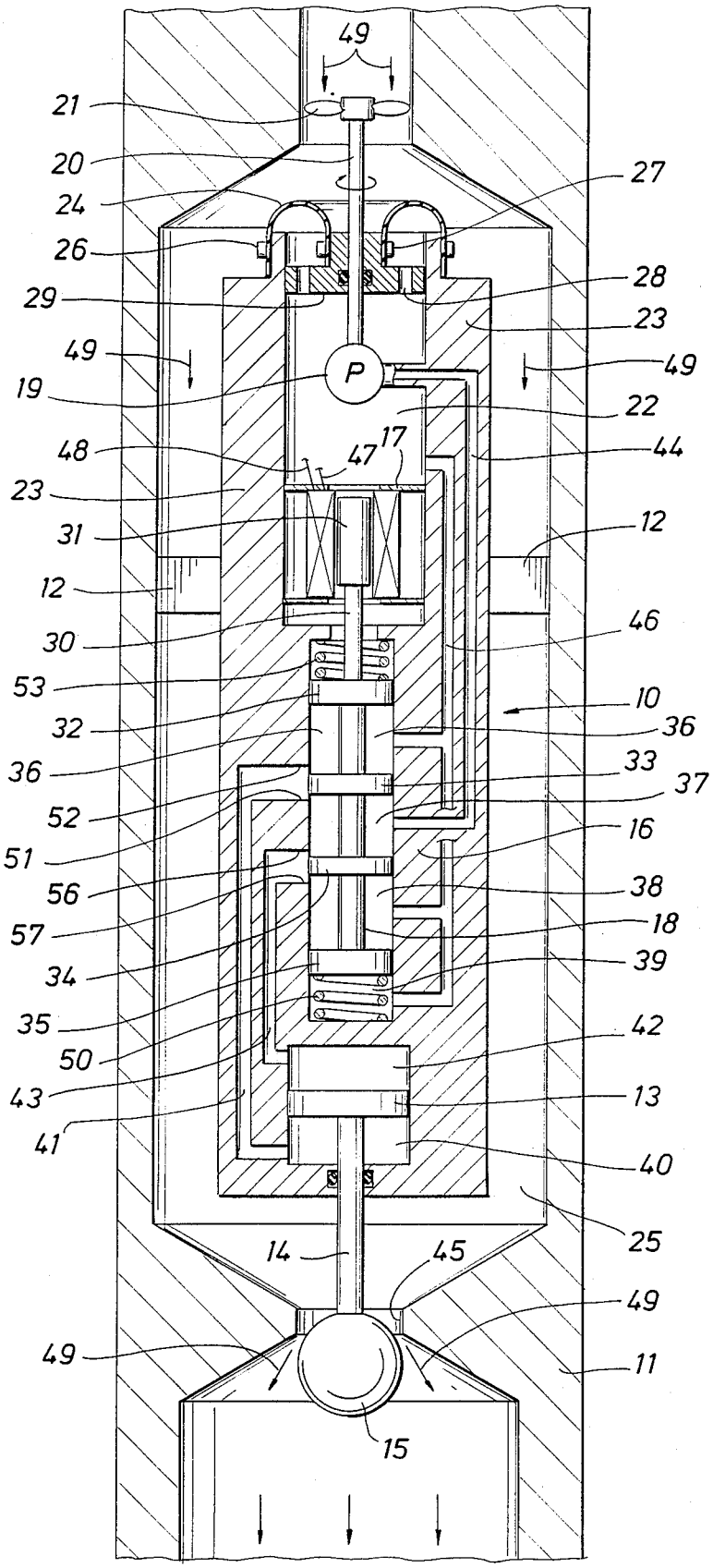
FIG. 1 is an assembly drawing, shown partially in section and partially in schematic, that illustrates a first and preferred construction of the orifice variation means of this invention.

An apparatus installed in a drill string is shown in FIG. 1. A plunger control assembly 10 is retained in place within a tubular housing 11 by a typical support spider bracket 12 where the assembly 10 includes a movable control piston 13 which connects to a piston rod 14 extending through a sealed passage in a bulkhead to locate and move a plunger 15. A control valve 16 directs fluid to and from the piston 13. An electrically powered solenoid 17 is connected to drive a spool member 18 of the control valve 16. A fluid pump 19 is driven by a drive shaft 20 rotatably powered by a drive impeller 21 attached thereto. The propeller is located in a fluid flow path to intercept drilling fluid flow.

The assembly 10 also houses a fluid reservoir 22 that is enclosed within a housing 23 by an inclosure diaphragm 24. The diaphragm 24 is a pliable member that allows equalization between the pressure of fluid within the reservoir 22 and fluid surrounding the housing 23. The fluid surrounding the housing 23 is contained within an elongate annulus space 25 of housing 11. The diaphragm 24 is secured to the housing 23 by clamp rings 26 and 27. Fluid ports 28 connect the reservoir 22 through a bulkhead 29 of the housing 23. The drive shaft 20 connected to the impeller 21 sealingly passes through the bulkhead 29 to connect with the pump 19 within the reservoir 22.

The spool member 18 of the control valve 16 has a section 30 connected to the movable core 31 within the solenoid 17. The spool 18 is constructed along its length with enlargements 32, 33, 34 and 35 which have circular exterior surfaces that slidably and sealingly engage the inner bore of the valve 16 to form separate fluid receiving chambers 36, 37, 38 and 39. Either one or both of the chambers 36 and 37, depending on the position of the spool enlargement 33, is connected by a conduit 41 to a first drive chamber 40 on one side of piston 13; likewise, either one or both of the chambers 37 and 38, depending on the position of the spool enlargement 34, connects by the conduit 43 to a second drive chamber 42 on the other side of the piston 13. The piston 13 is driven by fluid delivered either through the conduit 41 or the conduit 43.

The outlet of the pump 19 connects by a conduit 44 to the chamber 37 whereby pumped fluid may be directed by the spool 18 to either chamber 40 or 42 to position the plunger 15 within an orifice 45 whereby the flow area of the orifice 45 may vary according to positioning of the plunger 15. The inlet of the pump 19 connects through the reservoir 22 and a passage 46 to the chambers 36, 38 and 39 whereby return fluid and drainage fluid are returned to the reservoir 22 for flow into the pump 19.

The solenoid 17 connects by electrical leads 47 and 48 to a sensing instrument, in the a down hole logging tool whereby electrical current of different magnitudes is supplied to the solenoid 17 to move the plunger 18 according to the intensity and flow direction of the electrical current. The sensor has been omitted for sake of clarity. It is not necessary to explain the movement of the core 31 of the solenoid 17 responsive to an applied electrical current because this is well known.

The plunger control assembly 10 functions in the following manner so that the plunger 15 is positioned at different locations within the orifice 45 to thereby vary the flow area of the orifice 45. The chamber 22 is filled with a hydraulic fluid of desired characteristics. Circulating drilling fluid flows past the impeller 21 in the direction indicated by arrows 49 to drive the impeller 21 and power the pump 19 which pumps fluid through the conduit 44 to the chamber 37 to pressure either of the chambers 40 or 42 as selected by the spool 18. The spool thereby positions the plunger 15 within the orifice 45.

In the illustrated view of FIG. 1, the spool 18 is shown biased, assuming no electrical current applied to the solenoid 17, by the springs 50 and 53 to a desired neutral position whereby fluid from the pump 19 is directed to and from both the chambers 40 and 42. This neutral state allows the plunger 15 to assume a fully extended position as a result of flow of the fluid through the orifice 45. Electrical current in one direction is applied to the solenoid 17 to move the spool 18 in a direction to introduce fluid into the open conduit 41 through the opening at 51 and also close flow into the conduit 43 at the opening 46. Simultaneously, the conduit 41 is closed at the opening 52 while the conduit 43 is opened at the location 57. Pressure is increased in the chamber 40 due to an increase in return fluid flow restriction at the location 52. Therefore pressure applied to the piston 13 for moving the plunger 15 to decrease the net flow area of the orifice 45. Conversely, electrical current decreases the pressure in the chamber 40 to increase the net flow area of the orifice 45. Also, applied electrical current in the opposite direction will move the spool 18 in the opposite direction to increase pressure in the chamber 42 in a similar manner, if desired. Selected current flows and variations in the springs 53 and 50 for biasing the spool 18 to different neutral positions thus will be apparent to those versed in the art. However, the overall spool function is basically the same as that explained, so for simplification other options will not be detailed.

It is noted that the spool 18 is pressure balanced so that it can be moved in either direction freely except for spring loading by the springs 50 and 53. Thus by utilization of properly selected springs 50 and 53, a very small electrical current may be applied to the solenoid 17 to move the spool 18. Further, each different electrical current level applied to the solenoid 17 may move the spool 18 by a different distance since the springs 50 and 53 will increase in force as they are compressed. Therefore, a very small electrical current may be used to operate the spool 18 to thereby position the plunger 15 within the orifice 45 according to the electrical current level applied to the solenoid 17.

Consequently, first, second, or more electrical current levels of small magnitudes may be applied to position the spool 18 in corresponding first, second, or more positions to thereby supply corresponding first, second, or more pressures on the piston 13 to position the piston 13 for positioning the plunger 15 in corresponding first, second, or more locations within the orifice 45 to provide corresponding first, second, or more flow areas for the orifice 45.

In light of the foregoing explanation, it is obvious that when the pressure within the annulus 25 which forces fluid through the orifice 45 is held at a selected constant magnitude (say 2,000 p.s.i.), then first, second, or more flow rates of fluid will pass through the orifice 45 and that each flow rate is directly proportional to the corresponding first, second, or more current levels applied to the spool 18.

Thus, while a well is being drilled and drilling fluid is applied as the fluid medium passing through the orifice 45, then the first, second, or more flow rates of drilling fluid can be directly correlated to the first, second, or more electrical current levels that may be applied to the solenoid 17.

The basis for this correlation may be by use of calibration curves of electrical current versus flow rate produced by laboratory measurements using the same or duplicate orifice variance instruments and controlled calibration parameters. These techniques are well known in the art; hence it is not necessary to fully explain these correlation techniques. It is pointed out, however, that accurate correlation and interpretation of one flow curve against a second flow curve requires that both curves be produced having the same pressure relative to time within the annulus 25. For this reason, it is pragmatic, from a practical standpoint, to utilize selected pressures of constant magnitude within the annulus 25 which may be accurately duplicated.

Figure 2:
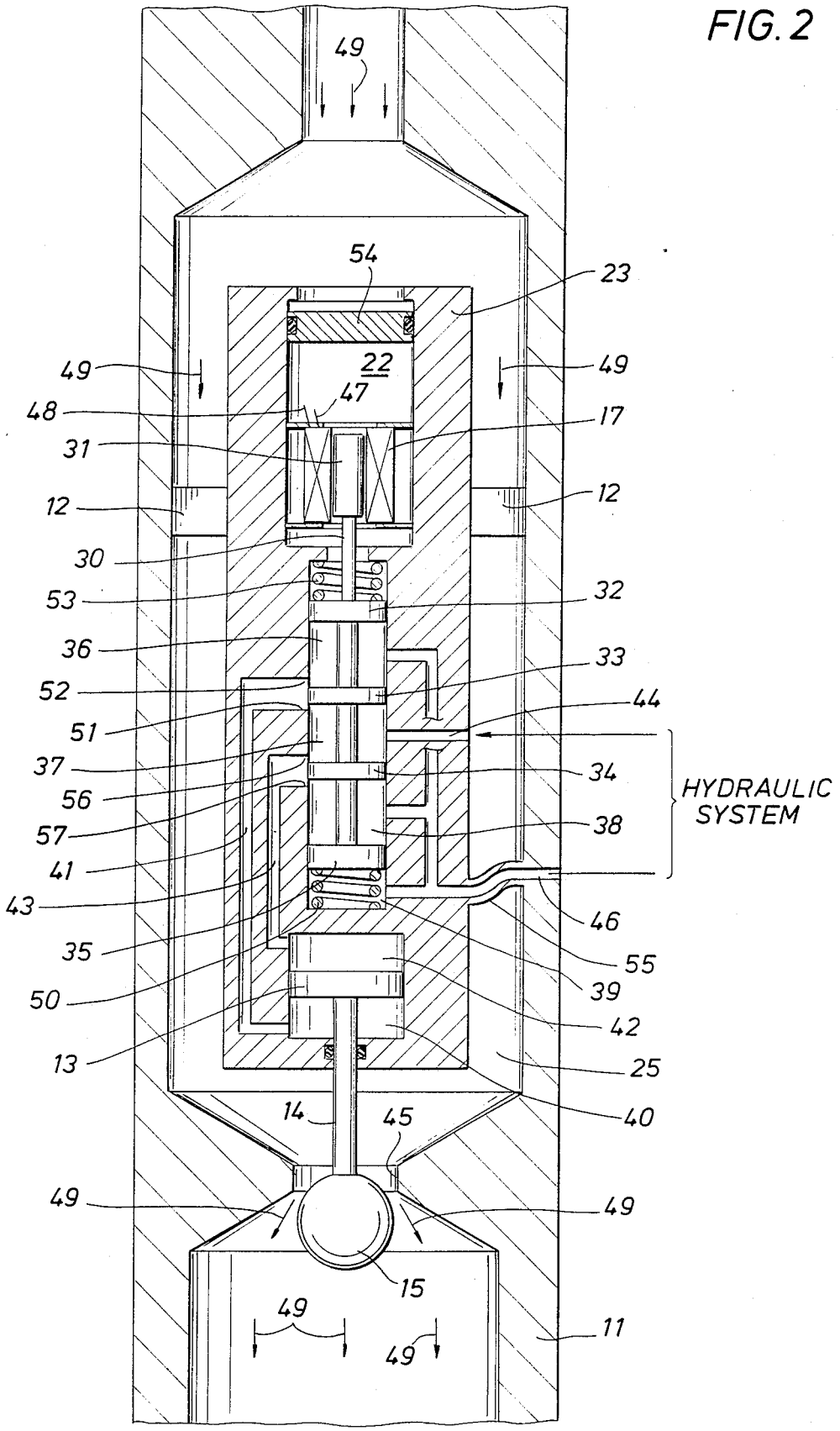
FIG. 2 is an assembly drawing, shown partially in section and partially in schematic, that illustrates a second or alternate form of the orifice variation means of this invention.

Attention is next directed to FIG. 2 of the drawings where a modified version of the present invention is disclosed. The control valve of FIG. 2 operates basically the same as disclosed for FIG. 1 except mud pressure is used to position the plunger 15 so that the drilling fluid that flows through the orifice 45 and creates system pressure for hydraulic fluid. The isolated hydraulic fluid is exhausted from chambers 36, 38 and 39 to lower pressure areas in the tool and remote from the housing 11. The fluid pump 19 and its drive means is eliminated, and the diaphragm 24 and the bulkhead 29 are replaced by a floating piston 54 which equalizes pressure on the isolated hydraulic fluid within the reservoir 22.

In FIG. 2, the conduit 44 is directed elsewhere to obtain pressured hydraulic fluid remote from the housing 11; also, the conduit 46 exhausts fluid from the chambers 36, 38 and 39 to the exterior of housing 11 by a connection 55 which may be a hose or similar connection. The conduit 44 may include a feed line from a remote pump for operation of piston 13.

While the foregoing is directed to first and second preferred embodiments, the scope hereof is defined by the claims which follow.

What is claimed is:

1. A measuring while drilling (MWD) control apparatus for forming a variation in drilling fluid flow through an orifice along a drill string to enable transmission of data along the drill string from sensors associated with the MWD apparatus, the apparatus comprising:

(a) an elongate body having a narrowed circular valve seat therein defining a drilling fluid flow path along an axis thereof;

(b) a valve element having the form of a plug positioned relative to said valve seat;

(c) a movable stem supporting said valve element for moving said valve element into and away from said valve seat to vary flow therethrough;

(d) powered means for moving said stem, said means further including:

(1) a closed chamber;

(2) a transverse piston sealed in said chamber and movable therein, said piston being connected with said stem;

(3) means for introducing pressure fluid into said chamber on two sides of said piston for driving said piston in response to pressure fluid in opposite directions;

(4) pump means for delivering pressure fluid to said chamber at one side or the other thereof for moving said piston in said chamber, and wherein said pump means delivers fluid under pressure to both sides of said piston to maintain a pressure balance on said piston; and (e) control means adapted to be connected with a sensor for inputting a variable to be encoded, said control means forming control signals capable of directing pressure fluid flow from said pump means to sustain a pressure balanced condition across said piston to hold said valve element in a stationary state against movement, and wherein said control means forms an unbalance which moves said piston and thereby moves said valve element against a force means restoring said piston to the balanced state.

2. The apparatus of claim 1 wherein said pump means delivers fluid under pressure to a first valve means, and said first valve means includes first and second outlets connected to opposite sides of said piston for delivering pressure fluid on opposite sides of said piston to maintain a pressure balance on said piston, and said first valve means modulates flow through first and second lines to said chamber for said piston.

3. The apparatus of claim 1 wherein said pump means supports an extending shaft having a turbine thereon exposed to flow of drilling fluid along the drill string for rotation to provide power to said pump means, and further wherein said pump means is isolated in a sealed chamber.

4. The apparatus of claim 3 wherein said sealed chamber encloses hydraulic fluid to be pumped by said pump means, and said pump means has an outlet line connected with said first valve means to deliver hydraulic fluid under pressure.

5. The apparatus of claim 1 wherein said stem extends axially through said valve seat and positions said valve element in concentric alignment therewith.

6. The apparatus of claim 2 wherein said elongate member includes an internal concentric axially extending closed housing defining an external flow path for drilling fluid therearound and said housing encloses said first valve means and pump means.

7. The apparatus of claim 6 wherein said housing encloses an electrically powered spool connected with a shaft connecting with valve elements comprising said first valve means.

8. The apparatus of claim 7 wherein said shaft supports at least two valve elements thereon spaced along said shaft, and said valve elements cooperate with a surrounding cylinder defining multiple chambers along said cylinder and further including resilient means for urging said first valve means to a centralized pressure balanced fluid operated means.

9. The apparatus of claim 8 wherein said chamber means incorporates a pressure transferring fluid separating diaphragm covering a portion thereof to separate drilling fluid for flow along said housing and hydraulic fluid for operation of said first valve means.

10. The apparatus of claim 9 wherein said housing includes lengthwise passages formed therein for delivery of fluid from said pump means to said first valve means.

11. The apparatus of claim 10 wherein said first valve means delivers fluid under pressure to first and second outlet lines which are respectively connected to said chamber and provide fluid input at opposite ends of said chamber for pressure balance provided to said piston therein.

* * * * *